US010222161B2

(12) United States Patent
Bender

(10) Patent No.: US 10,222,161 B2
(45) Date of Patent: Mar. 5, 2019

(54) TRIGGER ASSEMBLY

(71) Applicant: In Ovation LLC, Minneapolis, MN (US)

(72) Inventor: Terrence Dwight Bender, Minneapolis, MN (US)

(73) Assignee: In Ovation LLC, Minneapolis, MN (US)

( * ) Notice: Subject to any disclaimer, the term of this patent is extended or adjusted under 35 U.S.C. 154(b) by 0 days.

(21) Appl. No.: 15/588,594

(22) Filed: May 6, 2017

(65) Prior Publication Data

US 2017/0321983 A1 Nov. 9, 2017

Related U.S. Application Data

(60) Provisional application No. 62/332,744, filed on May 6, 2016.

(51) Int. Cl.
*F41A 19/19* (2006.01)
*F41A 19/14* (2006.01)

(52) U.S. Cl.
CPC ..... *F41A 19/14* (2013.01)

(58) Field of Classification Search
CPC ..... F41A 19/14; F41A 19/10; F41A 19/43; F41A 19/47
USPC ..... 42/69.01, 69.02, 69.03; 89/146, 147
See application file for complete search history.

(56) References Cited

U.S. PATENT DOCUMENTS 2,512,638 A * 6/1950 Gaidos ..... F41A 19/46 42/69.01
2,539,447 A * 1/1951 Lochhead ..... F41A 19/46 42/69.03
2,626,476 A * 1/1953 Miller ..... F41A 19/24 42/69.03
3,029,708 A * 4/1962 Marchisio ..... F41A 19/03 42/69.03
3,421,243 A * 1/1969 Browning ..... F41A 19/21 42/42.01
3,710,495 A * 1/1973 Ziegler ..... F41A 3/82 42/69.03

(Continued)

OTHER PUBLICATIONS

Zediker, Glenn, AR15 Triggers, Zediker Publishing, 2007, pp. 1-3.

(Continued)

*Primary Examiner* — Joshua E Freeman
(74) *Attorney, Agent, or Firm* — Vidas, Arrett & Steinkraus

(57) ABSTRACT

In some embodiments, a firearm trigger assembly comprises a hammer arranged to pivot on a hammer axis. The hammer comprises a cavity offset from the hammer axis, and the cavity has an opening that extends along a length of the cavity. A secondary biasing mechanism comprises a support member and a biasing member. The support member comprises a first portion oriented in the cavity and a second portion arranged to support the biasing member. The first portion is fixedly attached to the second portion. The trigger assembly has a first orientation and a second orientation. The secondary biasing mechanism biases the hammer in a first direction about the hammer axis in the first orientation, and in a second direction about the hammer axis in the second orientation.

17 Claims, 6 Drawing Sheets

(56) References Cited

U.S. PATENT DOCUMENTS

| | | | | | |
|---|---|---|---|---|---|
| 3,791,061 | A * | 2/1974 | Tirone | F41A 19/24 | 42/41 |
| 4,310,981 | A | 1/1982 | Waddell | | |
| 5,012,604 | A * | 5/1991 | Rogers | F41A 19/16 | 42/69.03 |
| 5,320,023 | A * | 6/1994 | Erdem | F41A 3/66 | 42/7 |
| 5,349,773 | A * | 9/1994 | Sprangers | F41A 19/14 | 42/42.02 |
| 5,463,829 | A | 11/1995 | Sprangers | | |
| 5,712,443 | A * | 1/1998 | Canaday | F41A 15/12 | 42/69.03 |
| 5,857,280 | A * | 1/1999 | Jewell | F41A 17/56 | 42/69.03 |
| 5,881,485 | A | 3/1999 | Milazzo | | |
| 5,904,132 | A | 5/1999 | Biller | | |
| 5,924,231 | A * | 7/1999 | Kidd | F41A 19/44 | 42/42.01 |
| 6,131,324 | A | 10/2000 | Jewell | | |
| 6,615,527 | B1 | 9/2003 | Martin | | |
| 6,722,072 | B1 | 4/2004 | McCormick | | |
| D504,168 | S | 4/2005 | McCormick | | |
| 7,076,902 | B2 * | 7/2006 | Hengstenberg | F41C 9/08 | 42/51 |
| 7,162,824 | B1 | 1/2007 | McCormick | | |
| 7,188,561 | B1 | 3/2007 | Kelbly | | |
| 7,293,385 | B2 | 11/2007 | McCormick | | |
| 7,331,136 | B2 | 2/2008 | Geissele | | |
| 7,421,937 | B1 | 9/2008 | Gangl | | |
| 7,526,889 | B2 | 5/2009 | Metzger et al. | | |
| D593,617 | S | 6/2009 | Dochterman | | |
| 7,600,338 | B2 | 10/2009 | Geissele | | |
| 7,661,220 | B2 | 2/2010 | Crandall et al. | | |
| D624,609 | S | 9/2010 | Stein et al. | | |
| 7,854,084 | B1 | 12/2010 | Rutherford | | |
| D659,790 | S | 5/2012 | Geissele | | |
| 8,572,880 | B2 | 11/2013 | Bender | | |
| 8,667,881 | B1 | 3/2014 | Hawbaker | | |
| D716,404 | S | 10/2014 | Capps et al. | | |
| 9,046,313 | B1 * | 6/2015 | Lutton | F41A 17/46 | |
| 9,146,067 | B2 | 9/2015 | Stakes | | |
| D740,907 | S | 10/2015 | Oglesby | | |
| 9,267,751 | B2 * | 2/2016 | Ruiz | F41A 19/12 | |
| D750,725 | S | 3/2016 | Capps et al. | | |
| D755,339 | S | 5/2016 | Geissele | | |
| D757,199 | S | 5/2016 | Bender | | |
| D764,004 | S | 8/2016 | Bender | | |
| 9,696,103 | B2 * | 7/2017 | Bender | F41A 19/10 | |
| 9,952,012 | B2 * | 4/2018 | Fellows | F41A 19/14 | |
| 2001/0054246 | A1 * | 12/2001 | Guhring | F41A 19/16 | 42/69.03 |
| 2006/0101695 | A1 | 5/2006 | Longueira | | |
| 2008/0010889 | A1 | 1/2008 | Metzger et al. | | |
| 2009/0183414 | A1 | 7/2009 | Geissele | | |
| 2009/0266348 | A1 | 10/2009 | Yeh | | |
| 2010/0281739 | A1 | 11/2010 | Geissele | | |
| 2011/0185615 | A1 | 8/2011 | Gangl | | |
| 2012/0180356 | A1 * | 7/2012 | Bender | F41A 19/14 | 42/69.01 |
| 2013/0192116 | A1 | 8/2013 | Elftmann, Jr. | | |
| 2014/0075812 | A1 | 3/2014 | Johnson | | |
| 2014/0259845 | A1 | 9/2014 | Johnson | | |
| 2014/0366418 | A1 | 12/2014 | Stakes | | |
| 2015/0020426 | A1 | 1/2015 | Neergaard | | |
| 2015/0153125 | A1 | 6/2015 | Lutton et al. | | |
| 2015/0153126 | A1 * | 6/2015 | Bender | F41A 19/14 | 42/69.01 |
| 2015/0233662 | A1 | 8/2015 | Ruiz | | |
| 2015/0338182 | A1 | 11/2015 | Lipowski | | |
| 2016/0054085 | A1 * | 2/2016 | Miller | F41A 19/14 | 42/69.03 |
| 2016/0131448 | A1 | 5/2016 | Bender | | |
| 2016/0161202 | A1 * | 6/2016 | Larue | F41A 19/45 | 42/69.01 |
| 2016/0209157 | A1 * | 7/2016 | Bender | F41A 33/00 | |
| 2017/0321983 | A1 * | 11/2017 | Bender | F41A 19/14 | |

OTHER PUBLICATIONS http://www.compasslake.com/trigger.htm, Jan. 26, 2012.
http://www.jprifles.com/1.4.8.1_ezt.php, Jan. 26, 2012.
http://cmmginc.secure-mall.com/item/CMMG-Two-Stage-Trigger-1504, Jan. 26, 2012.
http://shopwilsoncombat.com/Tactical-Trigger-Unit-Single-Stage-Semi-Auto/productinfo/TR-TTU/?gclid=CP6b79SY8aYCFYQUKgodTRRBBg, Jan. 26, 2012.
http://www.midwayusa.com/product/709049/jewell-trigger-assembly-ar-15-small-pin-154-two-stage-matte, Jan. 26, 2012.
http://www.jardinc.com/index.php?option=com_content&view=article&id=12:ar-le&catid=18:ar-15-single-stage&Itemid=6, Jan. 26, 2012.
Schematic drawing, Gun Assy, BFG-50A, Serbu Firearms, Inc., Apr. 25, 2011, p. 1.
http://www.snipershide.com/forum/ubbthreads.php?ubb=showthreaded&Number=501733, Jan. 26, 2012.
http://geissele.com/index.aspx, Jan. 26, 2012.

* cited by examiner

TRIGGER ASSEMBLY

CROSS-REFERENCE TO RELATED APPLICATIONS

This application claims the benefit of U.S. Provisional Application No. 62/332,744, filed May 6, 2016, the entire content of which is hereby incorporated herein by reference.

BACKGROUND OF THE INVENTION

This invention relates to firearm trigger assemblies.

U.S. Pat. No. 8,572,880 teaches a trigger assembly and is hereby incorporated herein in its entirety.

There remains a need for novel trigger designs that provide benefits over prior designs.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a firearm trigger assembly comprises a hammer arranged to pivot on a hammer axis. The hammer comprises a cavity offset from the hammer axis, and the cavity has an opening that extends along a length of the cavity. A secondary biasing mechanism comprises a support member and a biasing member. The support member comprises a first portion oriented in the cavity and a second portion arranged to support the biasing member. The first portion is fixedly attached to the second portion. The trigger assembly has a first orientation and a second orientation. The secondary biasing mechanism biases the hammer in a first direction about the hammer axis in the first orientation, and in a second direction about the hammer axis in the second orientation.

In some embodiments, a firearm trigger assembly comprises a hammer arranged to pivot on a hammer axis and a hammer spring biasing the hammer in a first direction about the hammer axis. The hammer comprises a cavity offset from the hammer axis, and a sidewall of the cavity comprises an opening. A support member comprises a first shaft, a second shaft and a cross member attached between the first shaft and the second shaft. The cross member is oriented in the cavity of the hammer.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
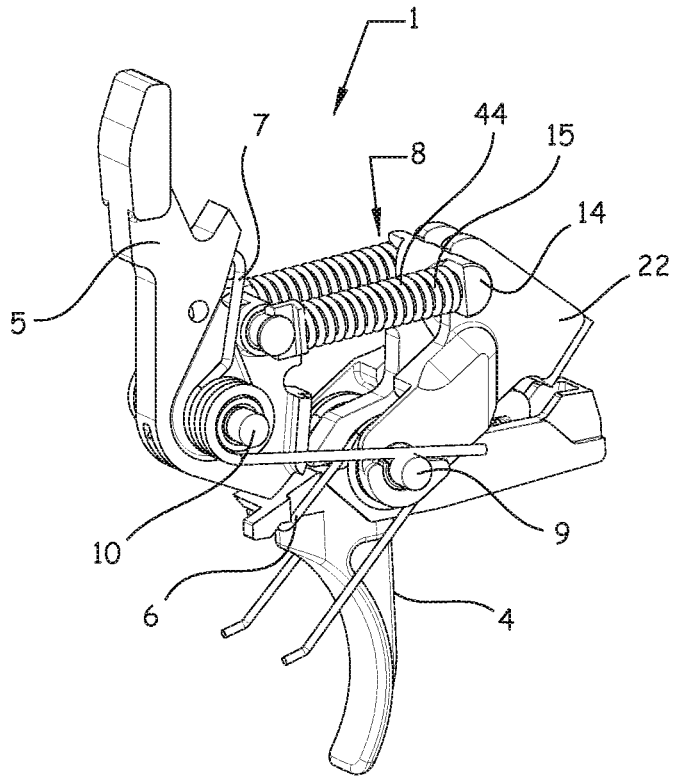
FIG. 1 shows an embodiment of a trigger assembly.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of a trigger assembly 1 comprising a trigger 4 arranged to pivot on a trigger axis and a hammer 5 arranged to pivot on a hammer axis. In some embodiments, the trigger 4 is supported by a trigger pin 9, wherein a central axis of the trigger pin defines the trigger axis. In some embodiments, the hammer 5 is supported by a hammer pin 10, wherein a central axis of the hammer pin defines the hammer axis. The trigger pin 9 and hammer pin 10 are typically supported by a housing (not shown). In some embodiments, the trigger pin 9 and hammer pin 10 are sized and arranged according to standard AR-10 or AR-15 dimensions, and will fit into a standard AR lower receiver.

The trigger assembly 1 further comprises a trigger biasing member 6 arranged to bias the trigger 4 in a predetermined rotational direction, and a hammer biasing member 7 arranged to bias the hammer 5 in a predetermined rotational direction. The trigger assembly 1 further comprises a secondary biasing mechanism 8 arranged to apply a force to the hammer 5. Desirably, a secondary biasing mechanism 8 applies a force to the hammer 5 at multiple orientations of the hammer 5. In some embodiments, the secondary biasing member 8 applies a force that cooperates with the hammer biasing member 7 in at least one orientation, and applies a force that counteracts the hammer biasing member 7 in at least one other orientation. In some embodiments, a secondary biasing mechanism 8 comprises a spring 44, a mounting shaft 15, a seat 14 and a frame 22.

Figure 2:
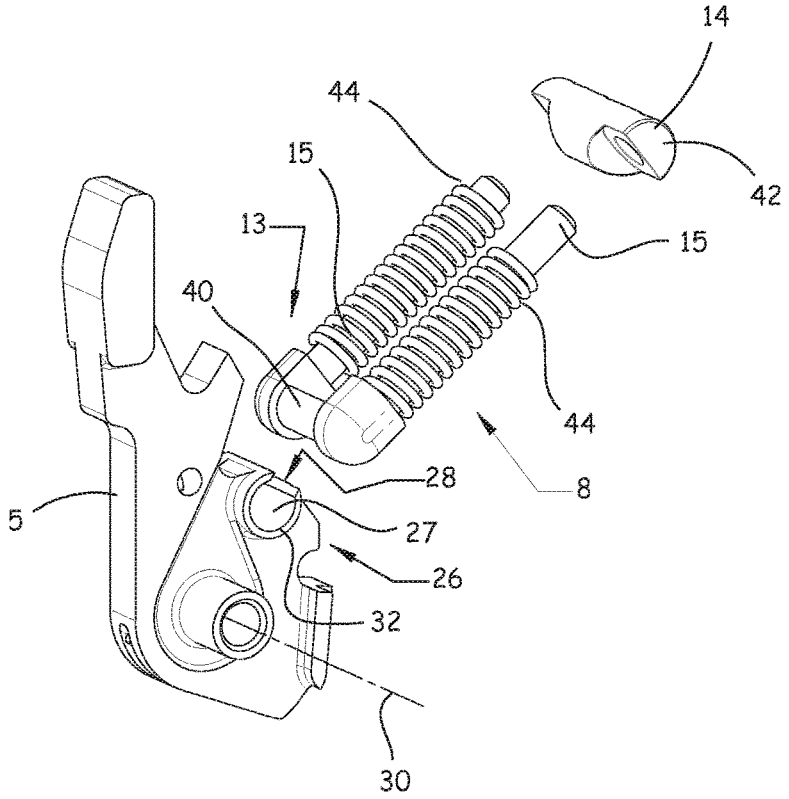
FIG. 2 shows an embodiment of a hammer and secondary biasing assembly.
Figure 3:
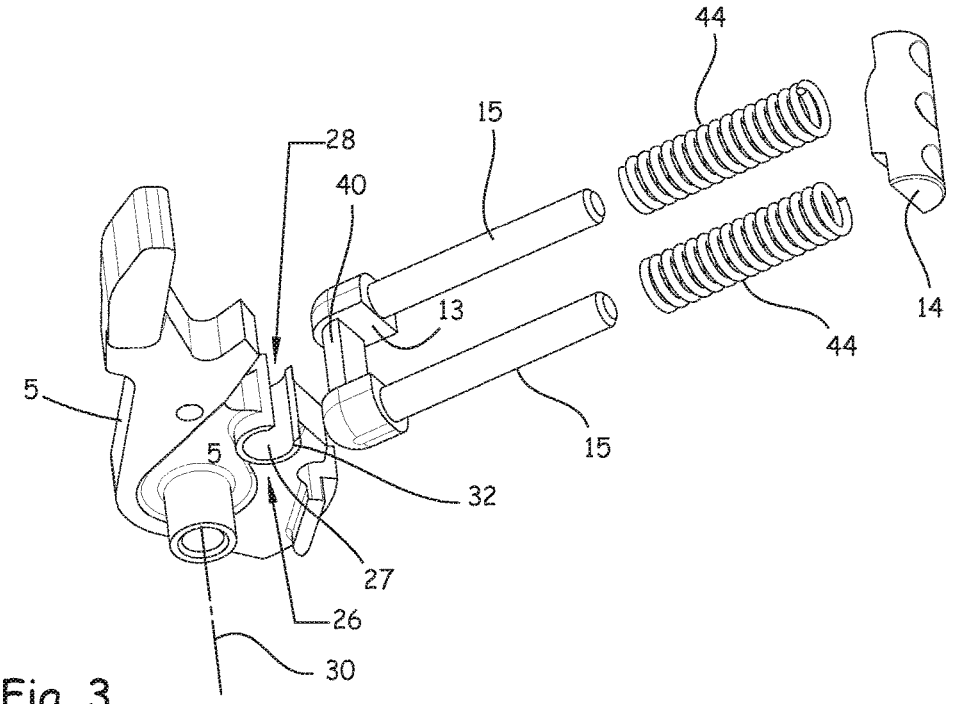
FIG. 3 shows an embodiment of a hammer and secondary biasing assembly.

FIGS. 2 and 3 show exploded views of certain components shown in FIG. 1. In some embodiments, a hammer 5 comprises an engagement location 26 that is arranged to engage the secondary biasing mechanism 8. In some embodiments, the engagement location 26 comprises a cavity 27 that is offset from the hammer axis 30. In some embodiments, the cavity 27 comprises open end portions. In some embodiments, the cavity 27 comprises an opening 28 extending along a length of the cavity 27. In some embodiments, the opening 28 comprises a slot. In some embodiments, a distance across the cavity 27 is greater than a distance across the opening 28. The cavity 27 can have any suitable size and shape. In some embodiments, an inner periphery 32 of the cavity 27 is arcuate. In some embodiments, at least a portion of an inner periphery 32 of the cavity 27 is semicircular. In some embodiments, a cross-sectional shape of the cavity 27 comprises a C-shape.

In some embodiments, the secondary biasing mechanism 8 comprises a support 13 that is arranged to engage the engagement location 26 of the hammer 5 and support at least one biasing member 44. In some embodiments, the support 13 comprises a hammer engaging portion 40 constructed and arranged to be oriented in the cavity 27 of the hammer 5. In some embodiments, the support 13 comprises one or more shaft(s) 15, wherein each shaft 15 can support a spring 44. In some embodiments, the shaft(s) 15 are oriented orthogonal to the hammer engaging portion 40.

Figure 4:
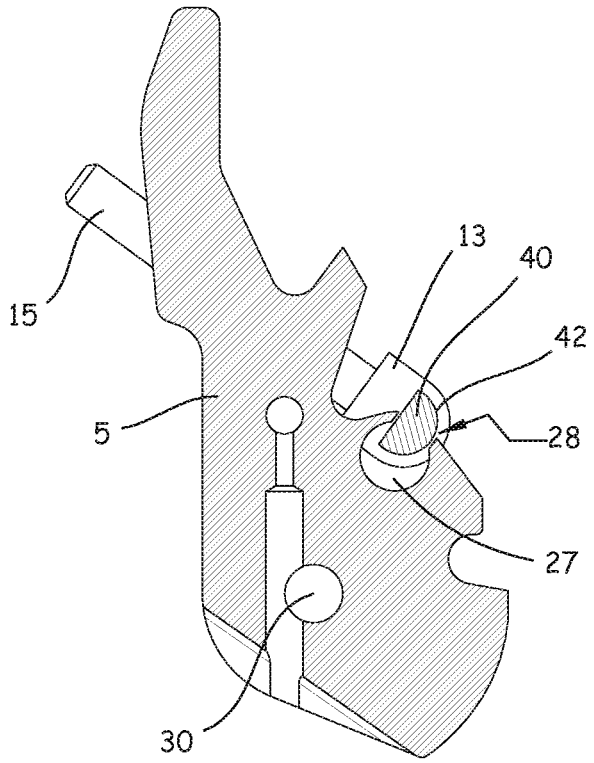
FIG. 4 shows a cross-sectional view of an embodiment of a hammer and an embodiment of a support member.

FIG. 4 shows a cross-sectional view of an embodiment of a hammer 5 and an embodiment of a support 13. In some embodiments, the hammer engaging portion 40 comprises an asymmetrical shape. In some embodiments, a distance across the hammer engaging portion 40 measured in one direction is different from a distance across the hammer engaging portion 40 measured in another (e.g. orthogonal) direction. In some embodiments, the distance across the hammer engaging portion 40 defines a minimum as measured in a first direction and defines a maximum as measured in a second (e.g. orthogonal) direction.

In some embodiments, a distance across the hammer engaging portion 40 as measured in the first direction is less than a distance across the cavity opening 28. In some embodiments, a distance across the hammer engaging portion 40 as measured in the second direction is greater than a distance across the cavity opening 28. Thus, the hammer engaging portion 40 can pass through the cavity opening 28 in certain orientations, but cannot pass through the cavity opening 28 in other orientations.

In some embodiments, the hammer engaging portion 40 comprises an arcuate surface 42 arranged to rotate within the hammer cavity 27. In some embodiments, the curvature of the arcuate surface 42 is similar to the curvature of a wall portion of the cavity 27 of the hammer 5.

Figure 5:
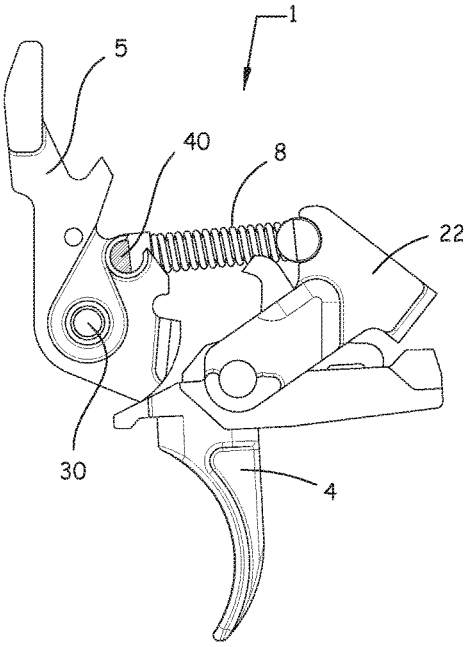
FIG. 5 shows an embodiment of a trigger assembly in a first orientation.

FIG. 5 shows an embodiment of a trigger assembly 1 in a first orientation. Force applied by the secondary biasing mechanism 8 to the hammer 5 biases the hammer 5 to rotate in a first direction about the hammer axis 30, for example cooperating with the main hammer biasing member.

Figure 6:
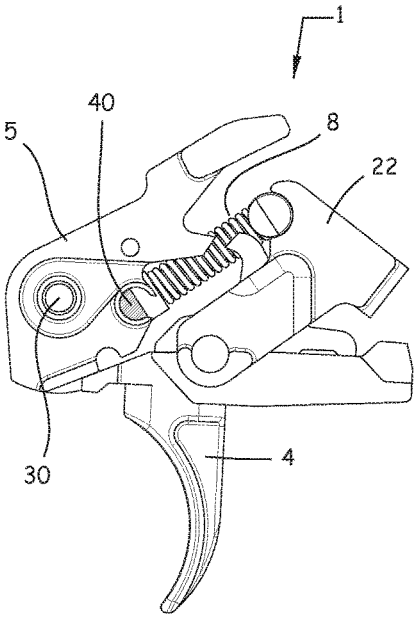
FIG. 6 shows an embodiment of a trigger assembly in a second orientation.

FIG. 6 shows the trigger assembly 1 of FIG. 5 in another orientation. Force applied by the secondary biasing mechanism 8 to the hammer 5 biases the hammer 5 to rotate in a second direction about the hammer axis 30, for example counteracting the main hammer biasing member.

Figure 7:
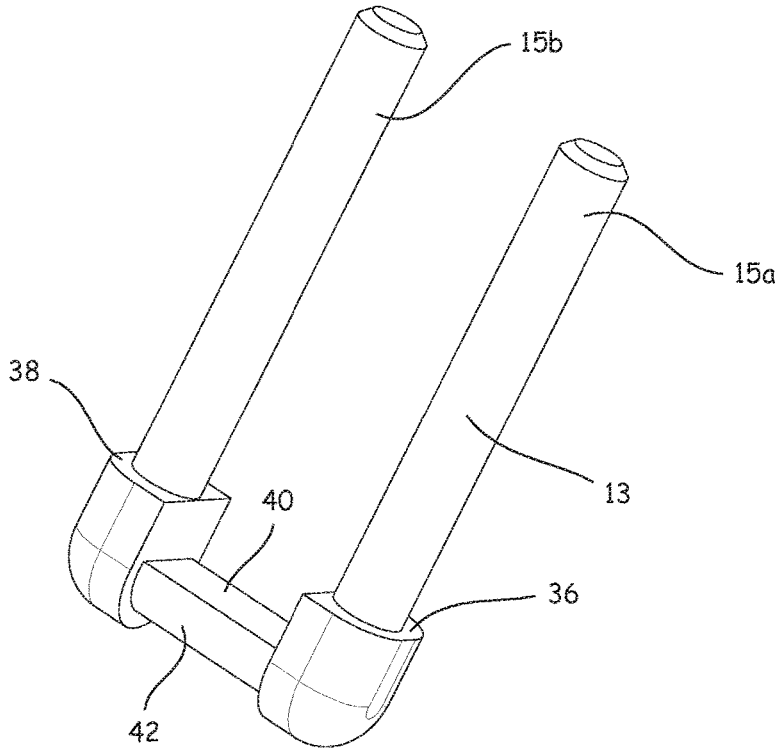
FIG. 7 shows an embodiment of a support member.

FIG. 7 shows an embodiment of a support member 13. In some embodiments, the support member 13 comprises the hammer engaging portion 40 and a first shaft 15*a*. In some embodiments, the support member 13 comprises a second shaft 15*b*. In some embodiments, the first shaft 15*a* and second shaft 15*b* extend parallel to one another. In some embodiments, the hammer engaging portion 40 comprises a cross member oriented between the first shaft 15*a* and the second shaft 15*b*.

In some embodiments, the support member 13 comprises a first flange 36 located adjacent to the first shaft 15*a*. In some embodiments, the first flange 36 comprises a surface arranged to abut a biasing member (e.g. 44). In some embodiments, the support member 13 comprises a second flange 38 located adjacent to the second shaft 15*b*. In some embodiments, the second flange 38 comprises a surface arranged to abut a biasing member (e.g. 44).

In some embodiments, a support member 13 comprises a first portion 40, a second portion 15*a* and a third portion 15*b*. In some embodiments, the first portion 40 is arranged to engage a hammer 5, and can be oriented in the cavity 27 of the hammer 5. In some embodiments, the second portion 15*a* is arranged to support a biasing member (e.g. 44). In some embodiments, the third portion 15*b* is arranged to support a second biasing member.

In some embodiments, a support member 13 as shown in FIG. 7 comprises a single piece of material. In some embodiments, all portions of the support member 13 as shown in FIG. 7 are integral. In some embodiments, the support member 13 is formed by a process comprising molding, for example providing a mold and flowing a material into the mold.

In some embodiments, a method of installing a trigger assembly comprises properly orienting the support 13 with respect to the cavity 27, passing the hammer engaging portion 40 through the cavity opening 28 and into the cavity 27. One or more springs 44 can then be installed on the shaft(s) 15.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A firearm trigger assembly comprising:

a hammer arranged to pivot on a hammer axis, the hammer comprising a cavity offset from the hammer axis, the cavity having an opening extending along a length of the cavity;

a secondary biasing mechanism comprising a support member and a biasing member, the support member comprising a first portion oriented in the cavity and a second portion arranged to support the biasing member, the first portion fixedly attached to the second portion;

the trigger assembly having a first orientation and a second orientation, the secondary biasing mechanism biasing the hammer in a first direction about the hammer axis in the first orientation, the secondary biasing mechanism biasing the hammer in a second direction about the hammer axis in the second orientation;

wherein the first portion of the support member cannot pass through the opening of the cavity in the first orientation or the second orientation.

2. The firearm trigger assembly of claim 1, a cross-sectional shape of the cavity comprising a C-shape.

3. The firearm trigger assembly of claim 1, wherein the first portion of the support member is integral with the second portion.

4. The firearm trigger assembly of claim 1, wherein the second portion of the support member comprises a shaft.

5. The firearm trigger assembly of claim 1, the support member formed by a process comprising molding.

6. The firearm trigger assembly of claim 1, wherein the first portion of the support member comprises an asymmetrical cross-sectional shape.

7. The firearm trigger assembly of claim 6, wherein the first portion of the support member comprises an arcuate surface.

8. The firearm trigger assembly of claim 1, the secondary biasing mechanism comprising a second biasing member, the support member comprising a third portion arranged to support the second biasing member.

9. The firearm trigger assembly of claim 8, the second portion of the support member comprising a first shaft, the third portion of the support member comprising a second shaft.

10. The firearm trigger assembly of claim 9, the first shaft parallel to the second shaft.

11. The firearm trigger assembly of claim 1, wherein the support member can assume a third orientation with respect to the hammer, the first portion of the support member arranged to pass though the opening of the cavity in the third orientation.

12. A firearm trigger assembly comprising:

a hammer arranged to pivot on a hammer axis, the hammer comprising a cavity offset from the hammer axis, the cavity having an opening extending along a length of the cavity;

a secondary biasing mechanism comprising a support member and a biasing member, the support member comprising a first portion oriented in the cavity and a second portion arranged to support the biasing member, the first portion fixedly attached to the second portion;

the trigger assembly having a first orientation and a second orientation, the secondary biasing mechanism biasing the hammer in a first direction about the hammer axis in the first orientation, the secondary biasing mechanism biasing the hammer in a second direction about the hammer axis in the second orientation;

wherein the first portion of the support member comprises an asymmetrical cross-sectional shape, the asymmetrical cross-sectional shape having a first dimension measured in a first direction and a second dimension measured orthogonal to the first direction.

13. The firearm trigger assembly of claim 12, wherein the first dimension is less than a distance across the opening of the cavity.

14. The firearm trigger assembly of claim 13, wherein the second dimension is greater than the distance across the opening of the cavity.

15. A firearm trigger assembly comprising:

a hammer arranged to pivot on a hammer axis, a hammer spring biasing the hammer in a first direction about the hammer axis, the hammer comprising a cavity offset from the hammer axis, a sidewall of the cavity comprising an opening;

a support member comprising a first shaft, a second shaft and a cross member attached between the first shaft and the second shaft, the cross member oriented in the cavity;

a cross-section of the cross member spanning a first distance as measured in a first direction and spanning a second distance as measured in a second direction orthogonal to the first direction, the first distance being less than a distance across the opening, the second distance being greater than the distance across the opening.

16. The firearm trigger assembly of claim 15, comprising a secondary biasing mechanism comprising the support member, a first biasing member supported by the first shaft and a second biasing member supported by the second shaft;

the trigger assembly having a first orientation and a second orientation, the secondary biasing mechanism biasing the hammer in the first direction about the hammer axis in the first orientation, the secondary biasing mechanism biasing the hammer in a second direction about the hammer axis in the second orientation.

17. The firearm trigger assembly of claim 15, the support member comprising a single piece of material.

* * * * *